US009635993B2

(12) United States Patent
Castellini

(10) Patent No.: US 9,635,993 B2
(45) Date of Patent: May 2, 2017

(54) WIDE AREA MOP

(71) Applicant: Jerry Castellini, Amarillo, TX (US)

(72) Inventor: Jerry Castellini, Amarillo, TX (US)

( * ) Notice: Subject to any disclaimer, the term of this patent is extended or adjusted under 35 U.S.C. 154(b) by 302 days.

(21) Appl. No.: 14/656,479

(22) Filed: Mar. 12, 2015

(65) Prior Publication Data

US 2015/0272417 A1 Oct. 1, 2015

Related U.S. Application Data

(60) Provisional application No. 61/971,706, filed on Mar. 28, 2014.

(51) Int. Cl.

| | |
|---|---|
| ***A47L 13/256*** | (2006.01) |
| ***A47L 13/20*** | (2006.01) |
| ***A47L 13/258*** | (2006.01) |
| ***A47L 13/29*** | (2006.01) |
| ***A47L 13/284*** | (2006.01) |

(52) U.S. Cl.

CPC ..... *A47L 13/256* (2013.01); *A47L 13/20* (2013.01); *A47L 13/258* (2013.01); *A47L 13/284* (2013.01); *A47L 13/29* (2013.01)

(58) Field of Classification Search

CPC ..... A47L 13/20; A47L 13/24; A47L 13/254; A47L 13/256; A47L 13/38; A47L 13/42; A47L 13/44; A47L 13/46; A47L 11/4036; A47L 13/28; A47L 13/284; A47L 13/29; B08B 1/001; B08B 1/006; A63D 5/10; A63B 2225/30; A63B 71/00; A63B 71/02; A63B 71/04

USPC ..... 15/147.1, 147.2, 228, 231, 98

See application file for complete search history.

(56) References Cited

FOREIGN PATENT DOCUMENTS

| | | | |
|---|---|---|---|
| CA | 2746838 | * | 7/2010 |
| GB | 487207 | * | 6/1938 |
| JP | 11-99114 | * | 4/1999 |
| JP | 2014-108117 | * | 6/2014 |

* cited by examiner

*Primary Examiner* — Mark Spisich

(57) ABSTRACT

A wide area mop is a device that is utilized to clean a large surface area such as an indoor court. The device features a rectangular mop base onto which a grommeted foldable cleaning cloth is removably attached via a plurality of fasteners and a plurality of hook fasteners. The rectangular mop base is physically dragged along behind the user via a pull cord, allowing the grommeted foldable cleaning cloth to accumulate dirt and grime. A set of circular weight plates is placed atop the grommeted foldable cleaning cloth once the grommeted foldable cleaning cloth is folded onto and secured to the rectangular mop base. The set of circular weight plates is able to provide additional weight to the rectangular mop base and the grommeted foldable cleaning cloth, allowing the device to more effectively scrub a surface.

20 Claims, 13 Drawing Sheets

DETAIL A

DETAIL B

SECTION C-C

DETAIL D

WIDE AREA MOP

The current application claims a priority to the U.S. Provisional Patent application Ser. No. 61/971,706 filed on Mar. 28, 2014.

FIELD OF THE INVENTION

The present invention relates generally to a mop for cleaning a surface. More specifically, the present invention is a wide area mop for cleaning large surface areas such as gymnasium and indoor court floors. The present invention allows a user to quickly and efficiently clean a large surface area.

BACKGROUND OF THE INVENTION

Many sports and activities such as basketball, racquetball, and volleyball are often played on indoor courts. Indoor courts are often polished extensively in order to create extremely smooth surfaces for players. An important aspect of proper maintenance of an indoor court is ensuring that the playing surface is kept clean. Dirt and debris accumulation, in addition to being unsightly, can result in adverse effects such as damage to the surface, disruption of gameplay, and even injury to players. To this end, it is important to properly maintain an indoor court surface for safety reasons as well as aesthetic reasons. It is common to utilize a cleaning device such as a mop as well as various surfactants and other cleaning products to clean indoor surfaces. However, while conventional mops are generally effective at cleaning indoor surfaces, indoor courts and similar spaces are often quite large. Because of the large surface area that must be covered, it can be difficult and/or time-consuming for one or two people to clean a large indoor surface to a satisfactory degree. As such, there is a need for a means for one or two people to efficiently and effectively clean a large indoor surface.

The present invention is a wide area mop that allows the user to quickly and effectively clean a large surface area such as an indoor court surface. The present invention may be pulled and dragged behind the user as the user travels around the indoor court surface. The present invention is designed to provide a wide cleaning surface that may be easily moved along a large area to be cleaned in order to allow the user to more quickly and efficiently clean the area. The present invention includes a variable weight system, allowing more or less pressure to be applied to the floor as needed to provide the best cleaning possible.

DETAIL DESCRIPTIONS OF THE INVENTION

All illustrations of the drawings are for the purpose of describing selected versions of the present invention and are not intended to limit the scope of the present invention.

Figure 1:
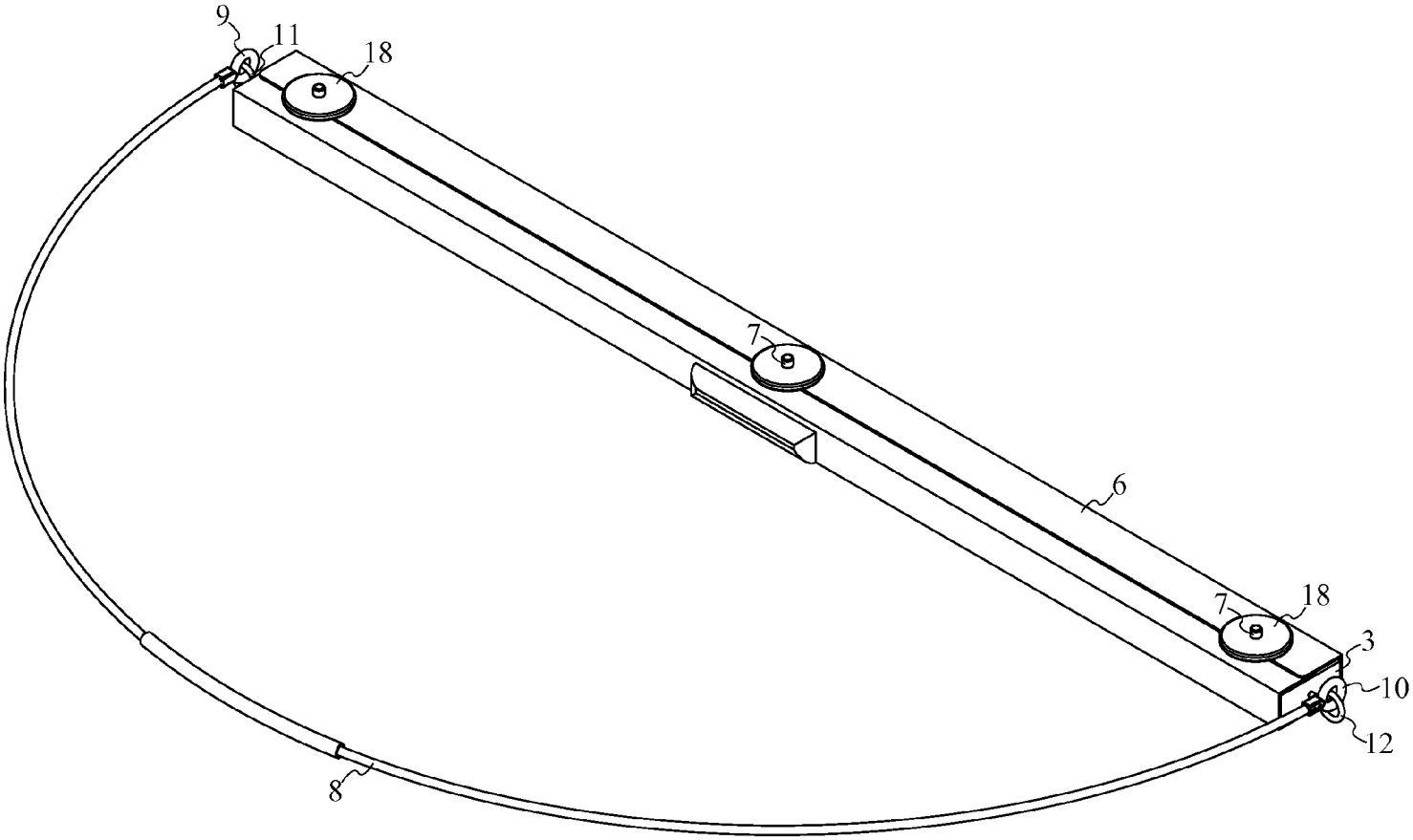
FIG. 1 is a perspective view of the present invention.
Figure 2:
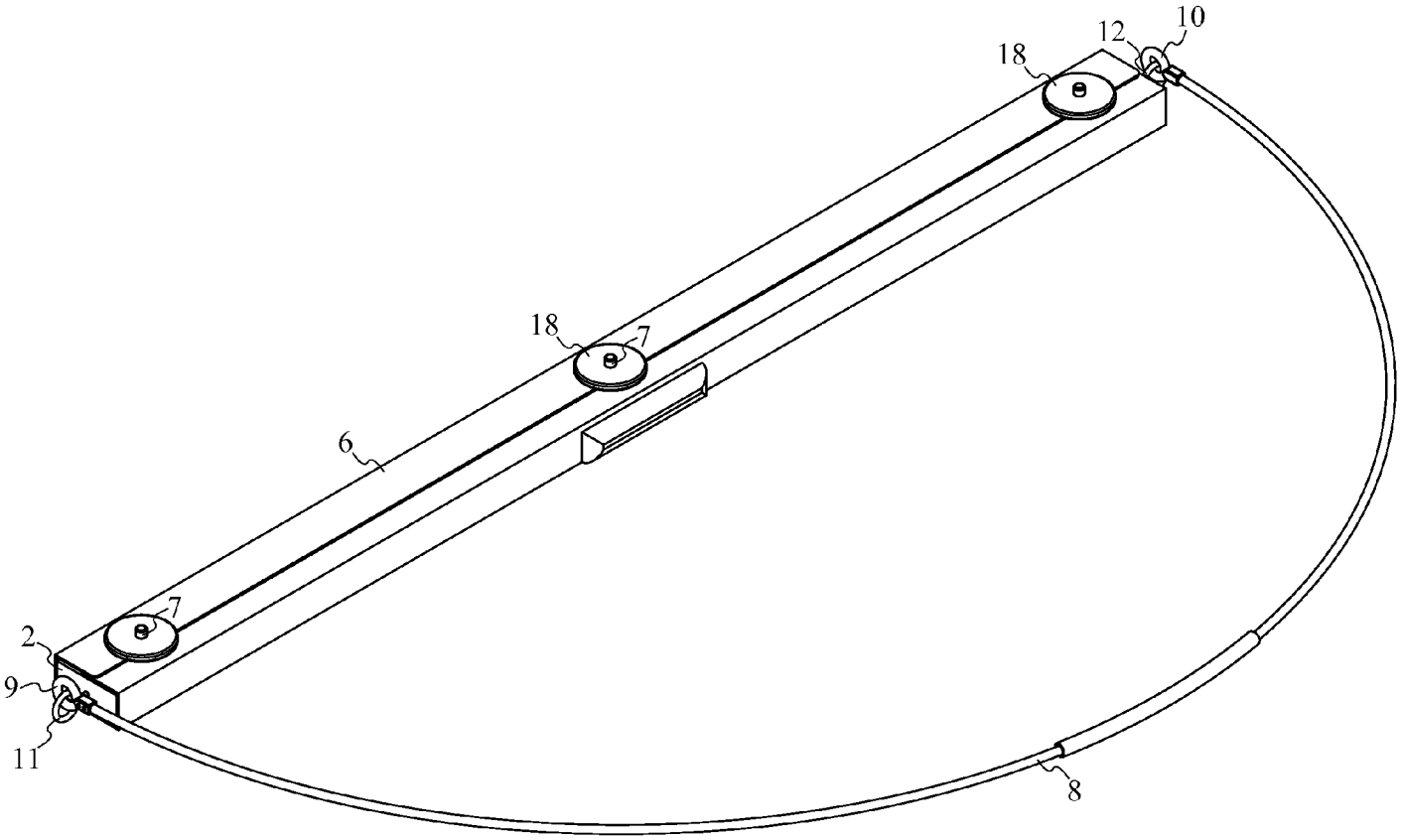
FIG. 2 is an additional perspective view of the present invention.

The present invention is a wide area mop with variable weight bearing system that is utilized to clean a large surface area in a quick and effective manner. With reference to FIG. 1 and FIG. 2, the present invention comprises a rectangular mop base 1, a grommeted foldable cleaning cloth 6, a plurality of fasteners 7, a pull cord 8, a first cord fastener 11, and a second cord fastener 12.

Figure 7:
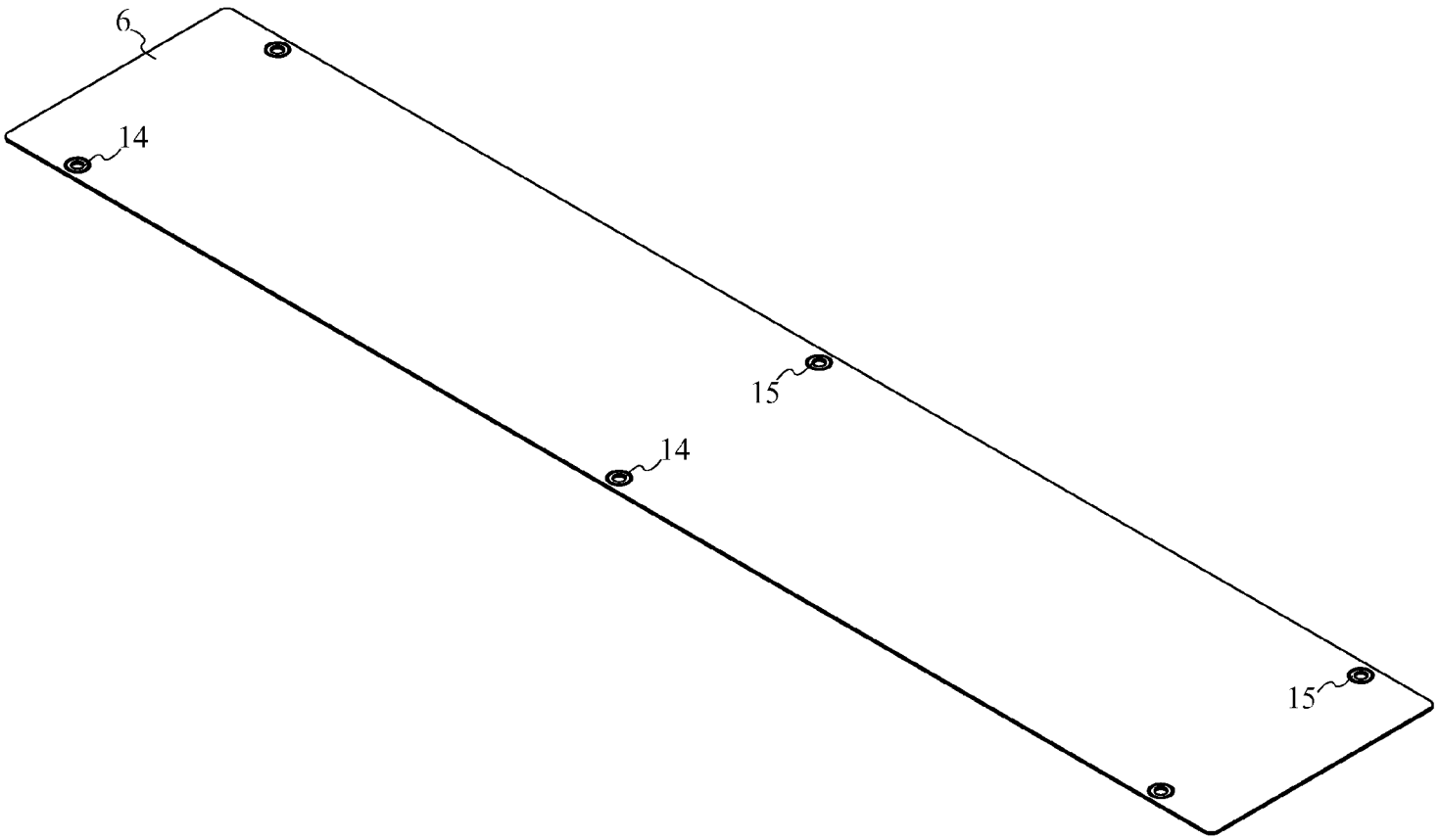
FIG. 7 is a perspective view of the grommeted foldable cleaning cloth.
Figure 8:
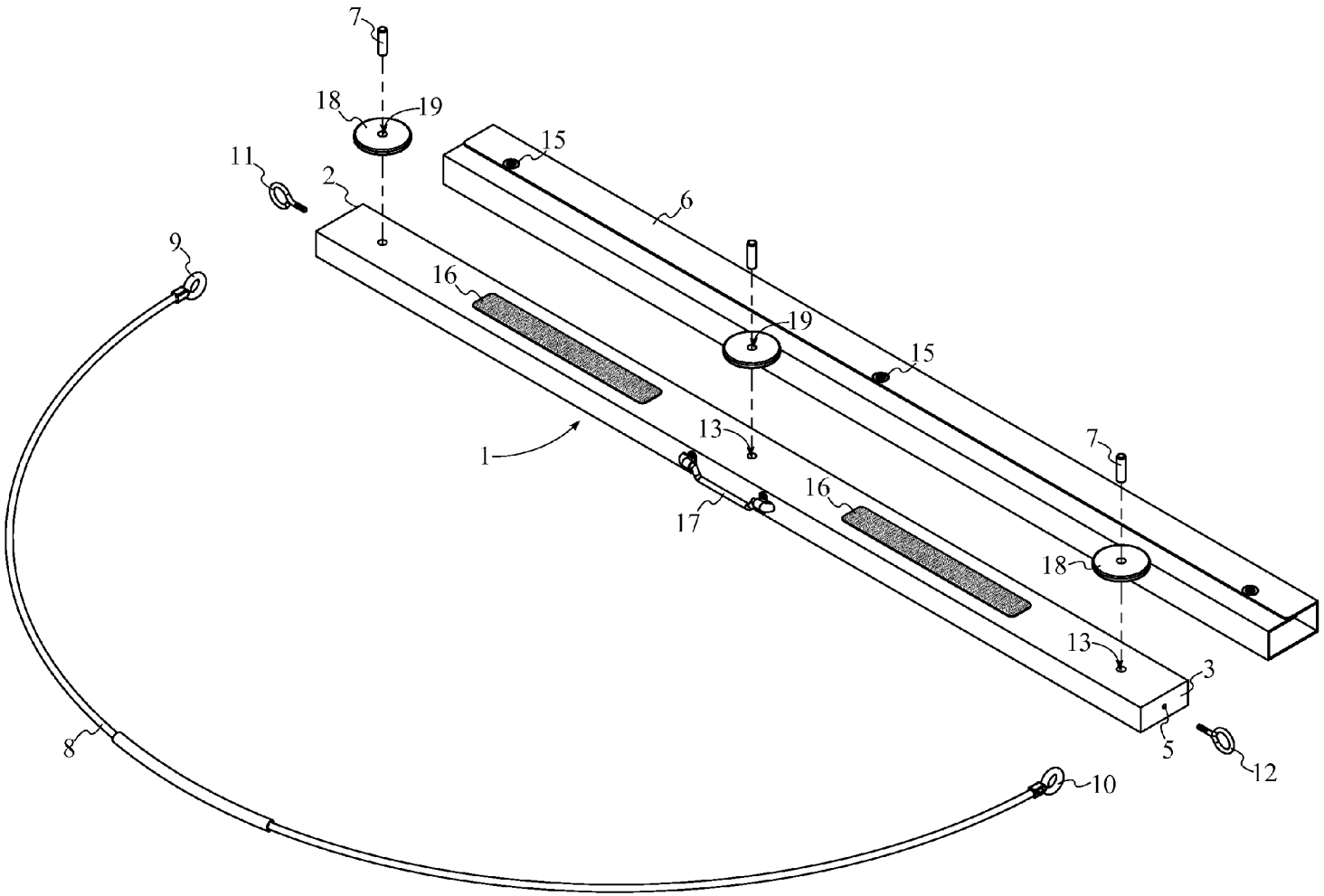
FIG. 8 is an exploded perspective view of the present invention.
Figure 9:
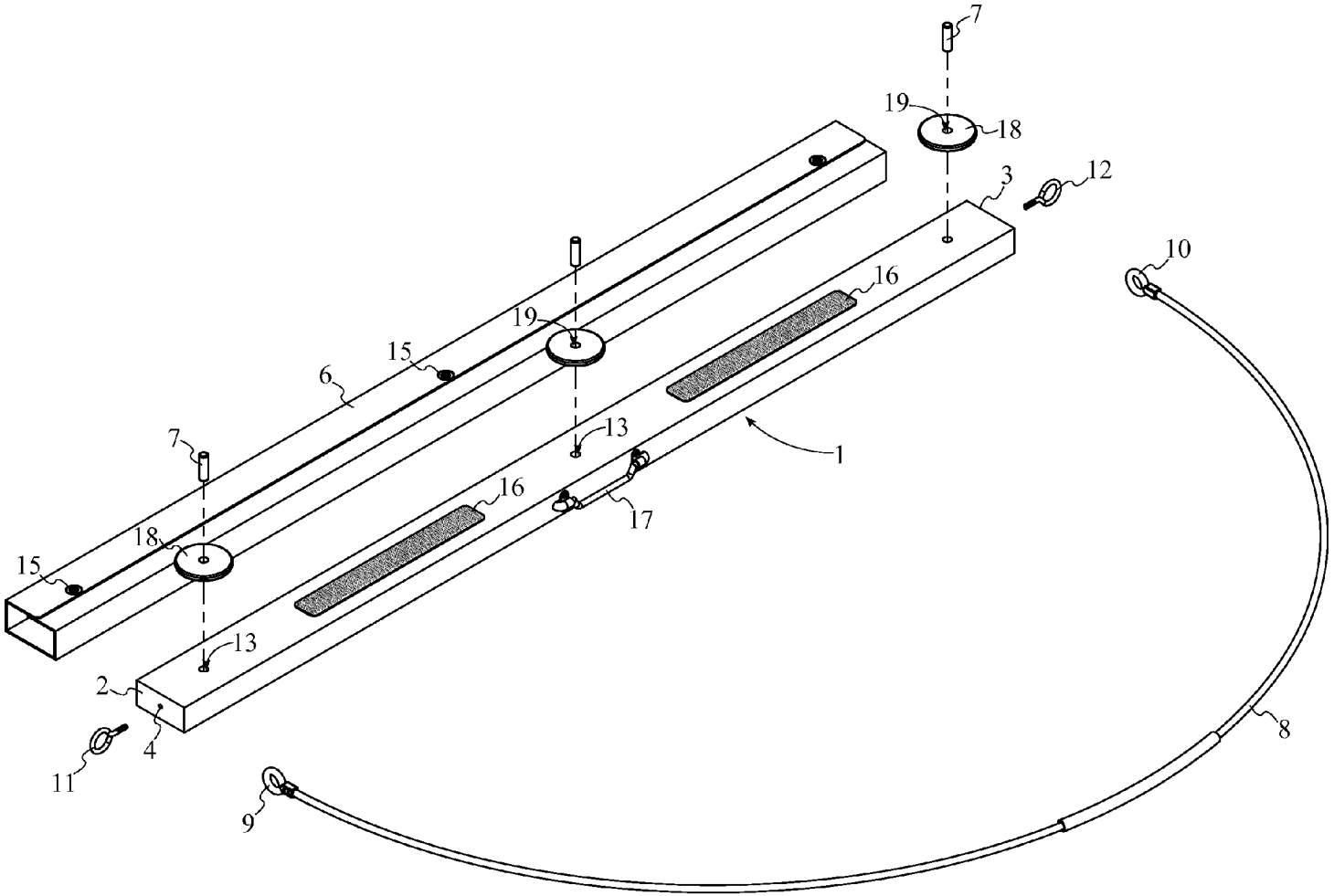
FIG. 9 is an additional exploded perspective view of the present invention.

The rectangular mop base 1 is shown in FIGS. 3-6 and serves as the structure onto which the other components of the present invention are attached. The rectangular mop base 1 is rigid and is sufficiently sized to cover a large area when the present invention is in use. Additionally, the rectangular mop base 1 is sufficiently weighted, with additional variable weight options available, to allow the rectangular mop base 1 to thoroughly clean a surface. The grommeted foldable cleaning cloth 6 is shown in FIG. 7 and is a cloth that comes into contact with a sullied surface during use of the present invention. The grommeted foldable cleaning cloth 6 is ideally absorbent in order to allow water and/or other cleaning solutions to be held and then transferred onto the sullied surface. The rectangular mop base 1 is removably enveloped by the grommeted foldable cleaning cloth 6, allowing the grommeted foldable cleaning cloth 6 to accumulate dirt and grime as the present invention is pulled along the surface. The grommeted foldable cleaning cloth 6 can be reversed and used on the opposing side which remains clean and allows two uses of the grommeted foldable cleaning cloth 6 prior to washing. The grommeted foldable cleaning cloth 6 may then be easily removed for washing. The plurality of fasteners 7 is utilized to secure the grommeted foldable cleaning cloth 6 to the rectangular mop base 1, preventing the grommeted foldable cleaning cloth 6 from separating from the rectangular mop base 1 during use as shown in FIG. 1 and FIG. 2. The plurality of fasteners 7 is engaged with the rectangular mop base 1 through the grommeted foldable cleaning cloth 6, allowing the plurality of fasteners 7 to assist in holding the grommeted foldable cleaning cloth 6 in place and allowing convenient removal of the grommeted foldable cleaning cloth 6. The rectangular mop base 1 comprises a first longitudinal end 2 and a second longitudinal end 3. The first longitudinal end 2 and the second longitudinal end 3 serve as mounting points for the pull cord 8, allowing the user to drag the rectangular mop base 1 along the surface by drawing on the pull cord 8. The first cord fastener 11 and the second cord fastener 12 are mounted into the first longitudinal end 2 and the second longitudinal end 3 as shown in FIG. 8 and FIG. 9, allowing the first cord fastener 11 and the second cord fastener 12 to hold the pull cord 8 in place on the rectangular mop base 1. The pull cord 8 is tethered to the first cord fastener 11 and the second cord fastener 12, causing the pull cord 8 to exert force on the first cord fastener 11, the first longitudinal end 2, the second cord fastener 12, and the second longitudinal end 3 when the pull cord 8 is drawn. In the preferred embodiment of the present invention, the first cord fastener 11 and the second cord fastener 12 are loops in order to allow one end of the pull cord 8 to be tied to the first cord fastener 11 and the other end of the pull cord 8 to the second cord fastener 12.

Figure 3:
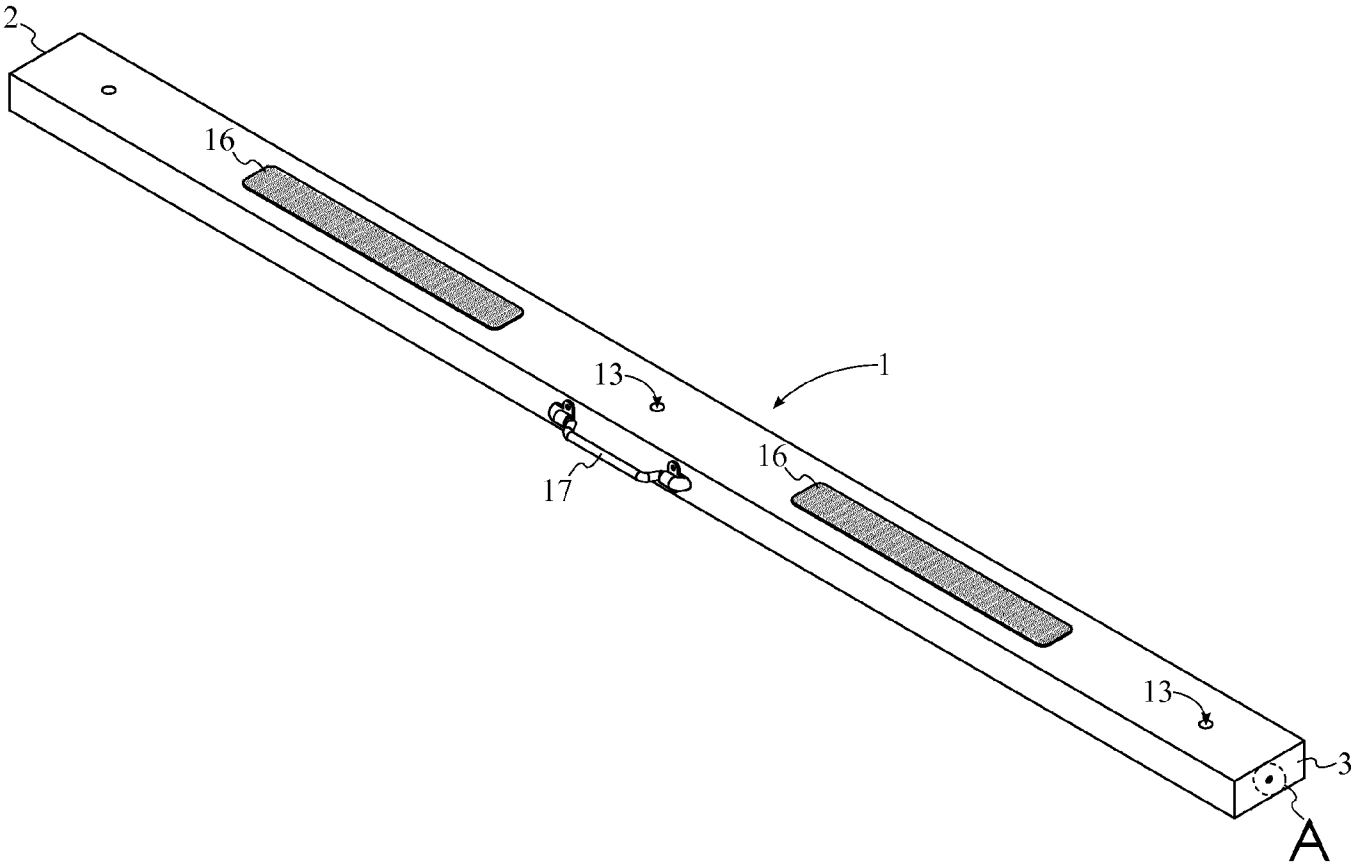
FIG. 3 is a perspective view of the rectangular mop base.
Figure 4:
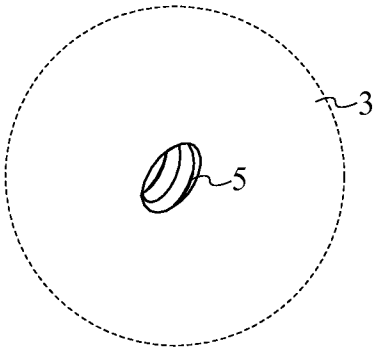
FIG. 4 is a detail view of the second female threading taken from circle A of FIG. 3.
Figure 5:
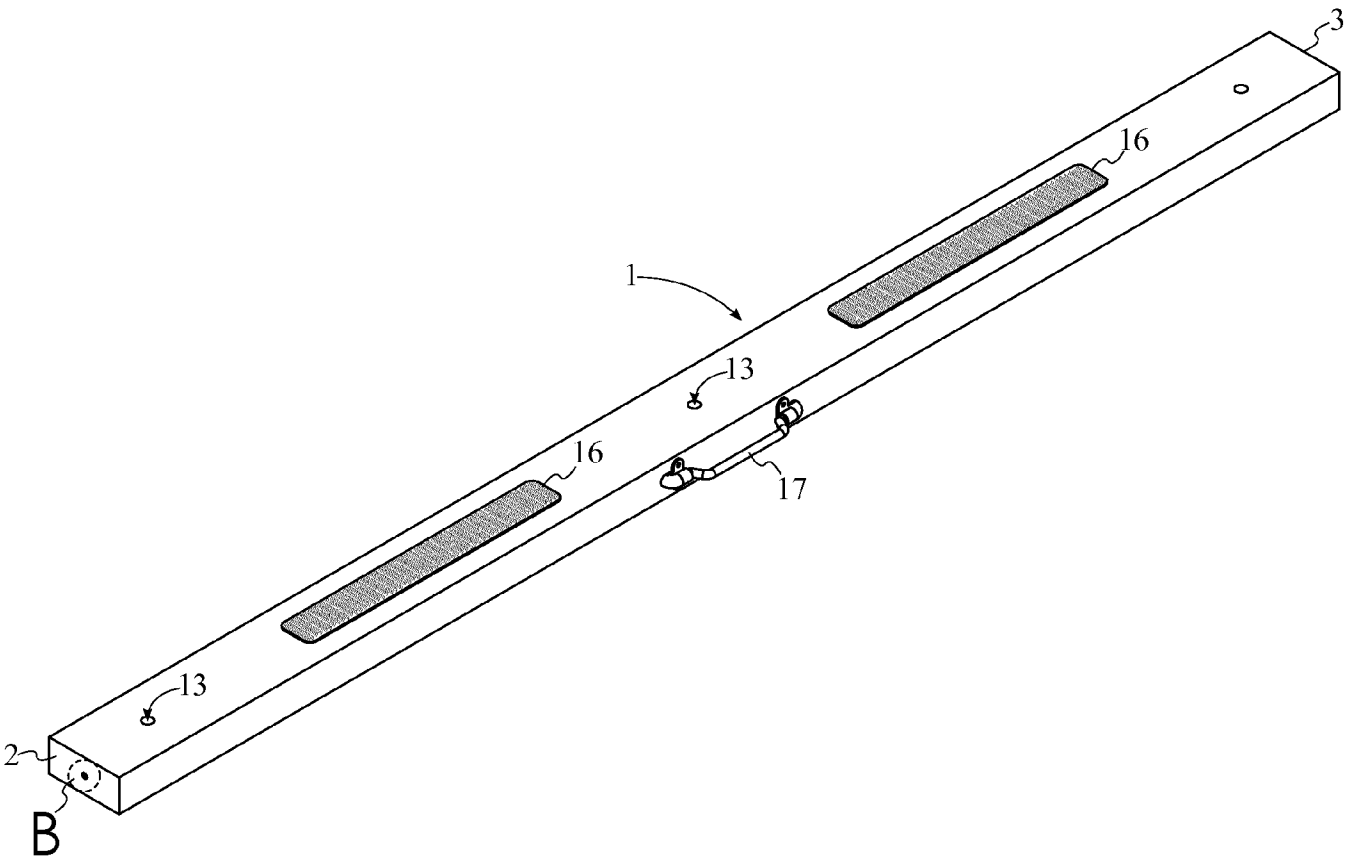
FIG. 5 is an additional perspective view of the rectangular mop base.
Figure 6:
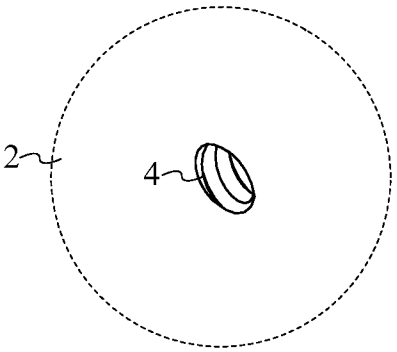
FIG. 6 is a detail view of the first female threading taken from circle B of FIG. 5.

The present invention further comprises a set of fastener openings 13 as shown in FIG. 3 and FIG. 5. The set of fastener openings 13 is able to accommodate the plurality of fasteners 7 when securing the grommeted foldable cleaning cloth 6 to the rectangular mop base 1. The set of fastener openings 13 is evenly distributed across the rectangular mop base 1. This allows the plurality of fasteners 7 to be distributed across the rectangular mop base 1 in order to secure the grommeted foldable cleaning cloth 6 to the rectangular mop base 1 at multiple points. The set of fastener openings 13 traverses into the rectangular mop base 1 and as such, the plurality of fasteners 7 is partially contained within the rectangular mop base 1 when the grommeted foldable cleaning cloth 6 is secured to the rectangular mop base 1. Each of the plurality of fasteners 7 is engaged into a corresponding fastener opening from the set of fastener openings 13 as shown in FIG. 8 and FIG. 9. In the preferred embodiment of the present invention, the plurality of fasteners 7 is not removable from the set of fastener openings 13. In the preferred embodiment of the present invention, the plurality of fasteners utilized to secure the grommeted foldable cleaning cloth 6 to the rectangular mop base 1 are pegs that are slotted into the set of fastener openings 13.

As shown in FIG. 1 and FIG. 2, the pull cord 8 comprises a first looped end 9 and a second looped end 10. The first looped end 9 and the second looped end 10 are designed to facilitate the attachment of the pull cord 8 to the rectangular mop base 1 through the first cord fastener 11 and the second cord fastener 12, respectively. The first looped end 9 is tethered to the first cord fastener 11 while the second looped end 10 is tethered to the second cord fastener 12. As such, in the preferred embodiment of the present invention, the loops of the first cord fastener 11 and the second cord fastener 12 may be easily tethered to the first looped end 9 and the second looped end 10.

Figure 10:
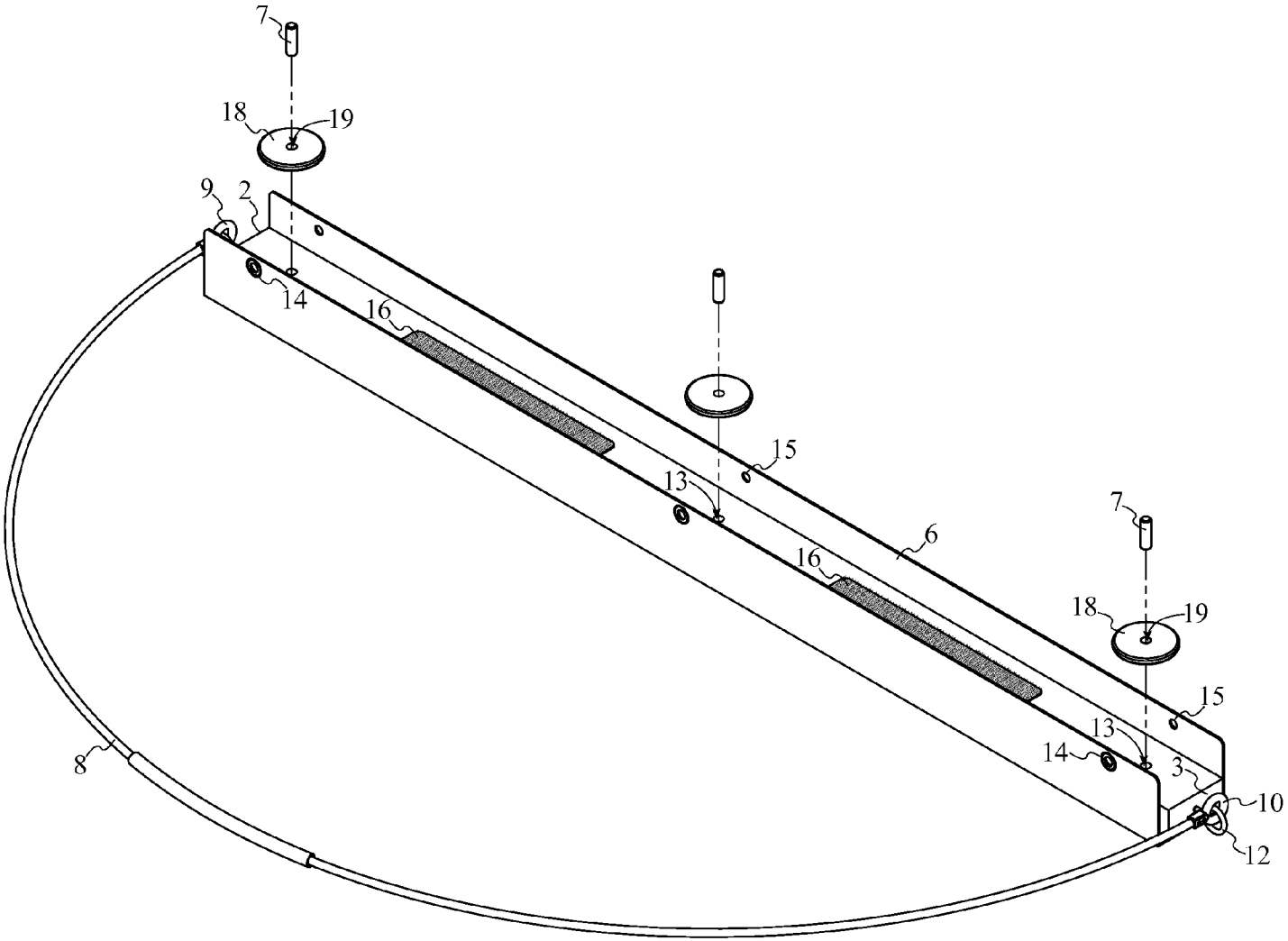
FIG. 10 is a partially exploded perspective view of the present invention.
Figure 11:
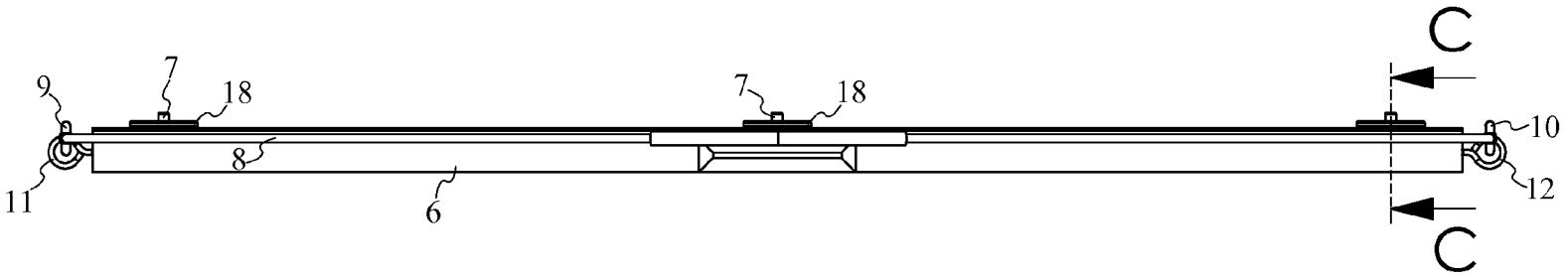
FIG. 11 is a front view of the present invention.
Figure 12:
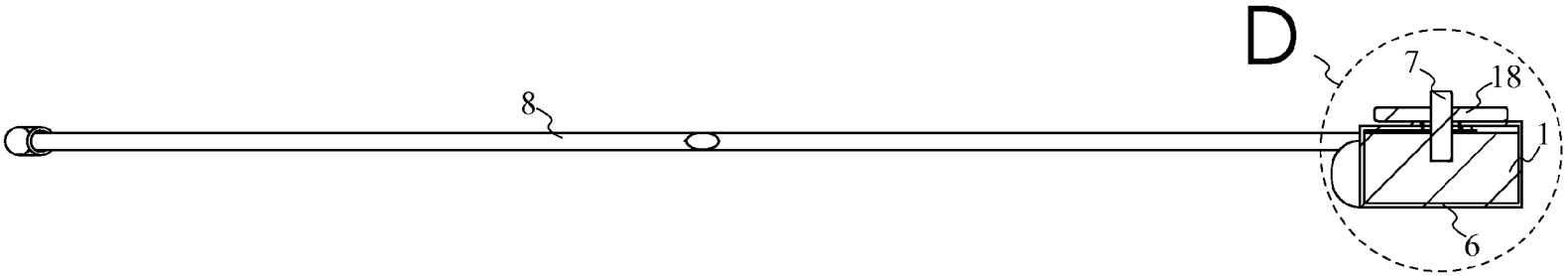
FIG. 12 is a cross-sectional view of the present invention taken along line C-C of FIG. 11.
Figure 13:
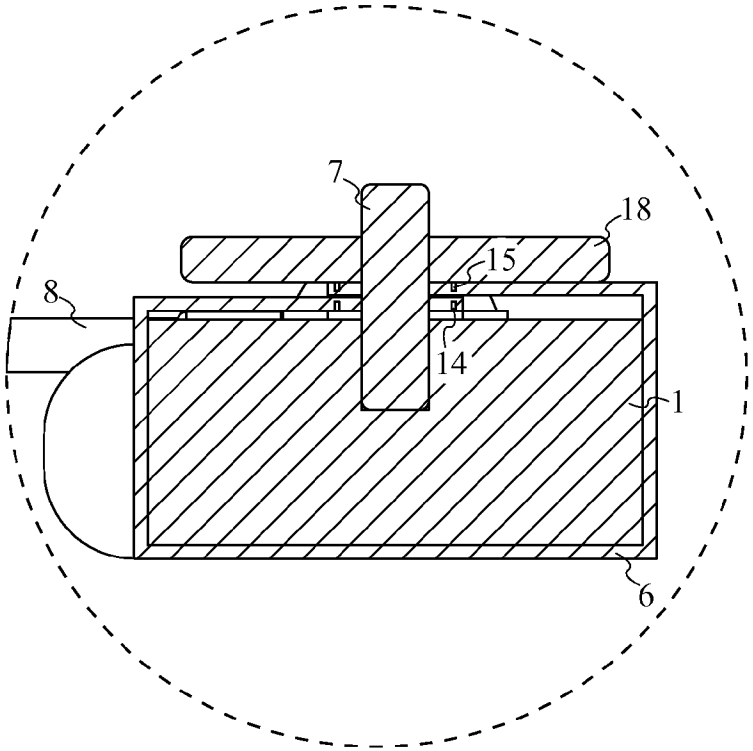
FIG. 13 is a detail view of the present invention taken from circle D of FIG. 12.

The present invention further comprises a first set of grommets 14 and a second set of grommets 15. The first set of grommets 14 and the second set of grommets 15 are sized and otherwise designed to accommodate the plurality of fasteners 7 when securing the grommeted foldable cleaning cloth 6 to the rectangular mop base 1. In the preferred embodiment of the present invention, the diameter of each of the first set of grommets 14 and the diameter of each of the second set of grommets 15 is slightly larger than the diameter of each of the plurality of fasteners 7. This allows the grommeted foldable cleaning cloth 6 to be easily removed from the rectangular mop base 1. The first set of grommets 14 and the second set of grommets 15 are embedded into the grommeted foldable cleaning cloth 6. This allows the plurality of fasteners 7 to pass through the grommeted foldable cleaning cloth 6 when the grommeted foldable cleaning cloth 6 is secured to the rectangular mop base 1. The first set of grommets 14 and the second set of grommets 15 are positioned opposite to each other across the grommeted foldable cleaning cloth 6 as shown in FIG. 7. This allows the first set of grommets 14 to overlap and be aligned with the second set of grommets 15 when the grommeted foldable cleaning cloth 6 is folded into place on the rectangular mop base 1 as shown in FIG. 10 and FIG. 11. Once the grommeted foldable cleaning cloth 6 is folded onto and secured to the rectangular mop base 1, each fastener from the plurality of fasteners 7 is mounted into a corresponding grommet from the first set of grommets 14, a corresponding grommet from the second set of grommets 15, and a corresponding opening from the set of fastener openings 13 as shown in FIG. 12 and FIG. 13. This allows the plurality of fasteners 7 to secure the grommeted foldable cleaning cloth 6 in place by mounting through the first set of grommets 14 and the second set of grommets 15 and into the rectangular mop base 1. The inclusion of the first set of grommets 14 and the second set of grommets 15 on opposite ends of the grommeted foldable cleaning cloth 6 allows the grommeted foldable cleaning cloth 6 allows the grommeted foldable cleaning cloth 6 to be used two times with clean surfaces prior to requiring washing.

The present invention further comprises a plurality of hook fasteners 16. The plurality of hook fasteners 16 provides additional security for the grommeted foldable cleaning cloth 6 on the rectangular mop base 1. The plurality of hook fasteners 16 is able to directly engage the grommeted foldable cleaning cloth 6, holding the grommeted foldable cleaning cloth 6 in place on the rectangular mop base 1. As shown in FIG. 3 and FIG. 5, the plurality of hook fasteners 16 is distributed across the rectangular mop base 1 in order to allow the plurality of hook fasteners 16 to hold the grommeted foldable cleaning cloth 6 in place at multiple points across the rectangular mop base 1. In the preferred embodiment of the present invention, the plurality of hook fasteners 16 is removably engaged to the grommeted foldable cleaning cloth 6. This allows the user to easily remove the grommeted foldable cleaning cloth 6 from the rectangular mop base 1 for washing.

As shown in FIGS. 3-6, the rectangular mop base 1 further comprises a first female threading 4 and a second female threading 5. The first female threading 4 and the second female threading 5 are utilized to secure the first cord fastener 11 and the second cord fastener 12 to the rectangular mop base 1. As such, the first female threading 4 is helically connected within the first longitudinal end 2 while the second female threading 5 is helically connected within the second longitudinal end 3 in order to allow the first cord fastener 11 and the second cord fastener 12 to be mounted into the first longitudinal end 2 and the second longitudinal end 3, respectively. The first cord fastener 11 is engaged to the first female threading 4 while the second cord fastener 12 is engaged to the second female threading 5, preventing the first cord fastener 11 and the second cord fastener 12 from being separated from the rectangular mop base 1.

The present invention further comprises a handle 17 as shown in FIG. 3 and FIG. 5. The handle 17 allows the user to grab, lift, and move the rectangular mop base 1 as needed. The handle 17 is mounted to the rectangular mop base 1 in between the first cord fastener 11 and the second cord fastener 12. As such, the handle 17 is positioned at the center of the rectangular mop base 1, allowing the rectangular mop base 1 to remain balanced when the rectangular mop base 1 is being moved. The handle 17 is oriented perpendicular to the plurality of hook fasteners 16 in order to prevent the handle 17 from obstructing the set of fastener openings 13 and the plurality of hook fasteners 16.

The present invention further comprises a set of circular weight plates 18. The set of circular weight plates 18 provide additional weight to the present invention when a surface is being cleaned. The additional weight allows the present invention to more effectively scrub the surface during the cleaning process. Each plate from the set of circular weight plates 18 comprises a circular opening 19. The circular opening 19 is able to interface with a corresponding fastener from the plurality of fasteners 7 as shown in FIGS. 10-13. The circular opening 19 of each plate from the set of circular weight plates 18 is positioned concentrically with a corresponding fastener from the plurality of fasteners 7. This allows the plurality of fasteners 7 to hold the set of circular weight plates 18 in place through the circular opening 19 of each plate from the set of circular weight plates 18. The set of circular weight plates 18 is positioned atop the grommeted foldable cleaning cloth 6. This allows the plurality of fasteners 7 to pass through the set of circular weight plates 18 and hold the set of circular weight plates 18 in place. Additionally, the set of circular weight plates 18 is able to further secure the grommeted foldable cleaning cloth 6 in place on the rectangular mop base 1 as well as provide more weight to the present invention in order to more effectively scrub a surface.

Although the present invention has been explained in relation to its preferred embodiment, it is understood that many other possible modifications and variations can be made without departing from the spirit and scope of the present invention as hereinafter claimed.

What is claimed is:

1. A wide area mop comprises:
a rectangular mop base;
a grommeted foldable cleaning cloth;
a plurality of fasteners;
a pull cord;
a first cord fastener;
a second cord fastener;
the rectangular mop base comprises a first longitudinal end and a second longitudinal end;
the rectangular mop base being removably enveloped by the grommeted foldable cleaning cloth;
the plurality of fasteners being engaged with the rectangular mop base through the grommeted foldable cleaning cloth;
the first cord fastener being mounted into the first longitudinal end;
the second cord fastener being mounted into the second longitudinal end; and
the pull cord being tethered to the first cord fastener and to the second cord fastener.

2. The wide area mop as claimed in claim 1, wherein the first cord fastener and the second cord fastener are loops.

3. The wide area mop as claimed in claim 1 further comprises:
a set of fastener openings;
the set of fastener openings being evenly distributed across the rectangular mop base;
the set of fastener openings traversing into the rectangular mop base; and
each of the plurality of fasteners being engaged into a corresponding fastener opening from the set of fastener openings.

4. The wide area mop as claimed in claim 3 further comprises:
a first set of grommets;
a second set of grommets;
the first set of grommets and the second set of grommets being embedded into the grommeted foldable cleaning cloth; and
the first set of grommets and the second set of grommets being positioned opposite to each other across the grommeted foldable cleaning cloth.

5. The wide area mop as claimed in claim 4 further comprises:
each of the plurality of fasteners being mounted into a corresponding grommet from the first set of grommets, a corresponding grommet from the second set of grommets, and a corresponding opening from the set of fastener openings.

6. The wide area mop as claimed in claim 3 further comprises:
a plurality of hook fasteners; and
the plurality of hook fasteners being distributed across the rectangular mop base, adjacent to the set of fastener openings.

7. The wide area mop as claimed in claim 6 further comprises:
the plurality of hook fasteners being removably engaged to the grommeted foldable cleaning cloth.

8. The wide area mop as claimed in claim 6 further comprises:
a handle;
the handle being mounted normal to the rectangular mop base in between the first cord fastener and the second cord fastener; and
the handle being oriented perpendicular to the plurality of hook fasteners.

9. The wide area mop as claimed in claim 1 further comprises:
the pull cord comprises a first looped end and a second looped end;
the first looped end being tethered to the first cord fastener; and
the second looped end being tethered to the second cord fastener.

10. The wide area mop as claimed in claim 1 further comprises:
the rectangular mop base further comprises a first female threading and a second female threading;
the first female threading being helically connected within the first longitudinal end;
the second female threading being helically connected within the second longitudinal end;
the first cord fastener being engaged to the first female threading; and
the second cord fastener being engaged to the second female threading.

11. The wide area mop as claimed in claim 1 further comprises:
a set of circular weight plates;
each plate from the set of circular weight plates comprises a circular opening;
the circular opening of each plate from the set of circular weight plates being positioned concentrically with a corresponding fastener from the plurality of fasteners; and
the set of circular weight plates being positioned atop the grommeted foldable cleaning cloth.

12. A wide area mop comprises:
a rectangular mop base;
a grommeted foldable cleaning cloth;
a plurality of fasteners;
a pull cord;
a first cord fastener;
a second cord fastener;
a set of circular weight plates;
a set of fastener openings;
the rectangular mop base comprises a first longitudinal end and a second longitudinal end;
the rectangular mop base being removably enveloped by the grommeted foldable cleaning cloth;

the plurality of fasteners being engaged with the rectangular mop base through the grommeted foldable cleaning cloth;

the first cord fastener and the second cord fastener being mounted into the first longitudinal end and the second longitudinal end, respectively;

the pull cord being tethered to the first cord fastener and to the second cord fastener;

each plate from the set of circular weight plates comprises a circular opening;

the circular opening of each plate from the set of circular weight plates being positioned concentrically with a corresponding fastener from the plurality of fasteners;

the set of circular weight plates being positioned atop the grommeted foldable cleaning cloth;

the set of fastener openings being evenly distributed across the rectangular mop base;

the set of fastener openings traversing into the rectangular mop base; and each of the plurality of fasteners being engaged into a corresponding fastener opening from the set of fastener openings.

13. The wide area mop as claimed in claim 12, wherein the first cord fastener and the second cord fastener are loops.

14. The wide area mop as claimed in claim 12 further comprises:

the pull cord comprises a first looped end and a second looped end;

the first looped end being tethered to the first cord fastener; and the second looped end being tethered to the second cord fastener.

15. The wide area mop as claimed in claim 12 further comprises:

a first set of grommets;

a second set of grommets;

the first set of grommets and the second set of grommets being embedded into the grommeted foldable cleaning cloth; and the first set of grommets and the second set of grommets being positioned opposite to each other across the grommeted foldable cleaning cloth.

16. The wide area mop as claimed in claim 15 further comprises:

each of the plurality of fasteners being mounted into a corresponding grommet from the first set of grommets, a corresponding grommet from the second set of grommets, and a corresponding opening from the set of fastener openings.

17. The wide area mop as claimed in claim 12 further comprises:

a plurality of hook fasteners; and the plurality of hook fasteners being distributed across the rectangular mop base, adjacent to the set of fastener openings.

18. The wide area mop as claimed in claim 17 further comprises:

the plurality of hook fasteners being removably engaged to the grommeted foldable cleaning cloth.

19. The wide area mop as claimed in claim 12 further comprises:

a handle;

the handle being mounted normal to the rectangular mop base in between the first cord fastener and the second cord fastener; and the handle being oriented perpendicular to the plurality of hook fasteners.

20. The wide area mop as claimed in claim 12 further comprises:

the rectangular mop base further comprises a first female threading and a second female threading;

the first female threading being helically connected within the first longitudinal end;

the second female threading being helically connected within the second longitudinal end;

the first cord fastener being engaged to the first female threading; and the second cord fastener being engaged to the second female threading.

* * * * *